US006755727B1

(12) United States Patent
Bjerkhoel

(10) Patent No.: US 6,755,727 B1
(45) Date of Patent: Jun. 29, 2004

(54) SANDING BLOCK FOR RECEIVING SANDING BELT

(76) Inventor: Warren Bjerkhoel, 19415 Sleepy Hollow Ct., Sonoma, CA (US) 95476

( * ) Notice: Subject to any disclaimer, the term of this patent is extended or adjusted under 35 U.S.C. 154(b) by 24 days.

(21) Appl. No.: 10/119,493

(22) Filed: Apr. 10, 2002

Related U.S. Application Data

(60) Provisional application No. 60/284,347, filed on Apr. 17, 2001.

(51) Int. Cl.[7] ..... B24D 17/00

(52) U.S. Cl. ..... 451/513; 451/495; 451/523

(58) Field of Search ..... 451/490, 495, 451/499, 492, 514, 523, 518, 513

(56) References Cited

U.S. PATENT DOCUMENTS 1,858,899 A * 5/1932 Montbriand ..... 451/503
1,947,054 A * 2/1934 McReynolds ..... 451/492
2,252,190 A * 8/1941 McAdams ..... 451/503
4,478,011 A * 10/1984 Russell ..... 451/492
6,196,909 B1 * 3/2001 Cadrobbi ..... 451/499
6,494,770 B1 * 12/2002 Carlson ..... 451/344

* cited by examiner

*Primary Examiner*—Dung Van Nguyen
(74) *Attorney, Agent, or Firm*—Jack Lo

(57) ABSTRACT

A sanding block includes a base member with a flat working surface for being positioned against a generally flattened sanding belt. A tightening arm has a first end hinged to a first end of the base member, and a second end movable between an open position away from a second end of the base member, and a closed position latched against the second end of the base member. A first retaining bar is secured to the tightening arm for engaging a first end of the sanding belt, and a second retaining bar is secured to the base member for engaging a second end of the sanding belt. When the tightening arm is opened, the first retaining bar is moved for slackening the sanding belt, and when the tightening arm is closed, the first retaining bar is moved for tightening the sanding belt against the working surface.

16 Claims, 3 Drawing Sheets

SANDING BLOCK FOR RECEIVING SANDING BELT

CROSS REFERENCE TO RELATED APPLICATIONS

I claim the benefit of provisional patent application No. 60/284,347 filed on Apr. 17, 2001.

BACKGROUND OF THE INVENTION

1. Field of the Invention

The invention broadly relates to sanding blocks.

2. Prior Art

Sanding blocks are devices for providing a rigid supporting surface for sandpaper. A typical sanding block comprises a shallow U-shaped member. A piece of sandpaper is positioned under the block and wrapped around to the top of the block and into a recessed part of the "U". A clamping member is secured in the recessed part to clamp the ends of the sandpaper in position. The disadvantage with such a sanding block is that the user must purchase large sheets of sandpaper and cut them into the proper size and shape to fit the sanding block. Also, typical sheets of sandpaper are relatively thin and easily torn during use.

BRIEF SUMMARY OF THE INVENTION

The present sanding block includes a base member with a flat working surface for being positioned against a generally flattened sanding belt. A tightening arm has a first end hinged to a first end of the base member, and a second end movable between an open position away from a second end of the base member, and a closed position latched against the second end of the base member. A first retaining bar is secured to the tightening arm for engaging a first end of the sanding belt, and a second retaining bar is secured to the base member for engaging a second end of the sanding belt. When the tightening arm is opened, the first retaining bar is moved for slackening the sanding belt, and when the tightening arm is closed, the first retaining bar is moved for tightening the sanding belt against the working surface.

DETAILED DESCRIPTION OF THE INVENTION

Figure 1:
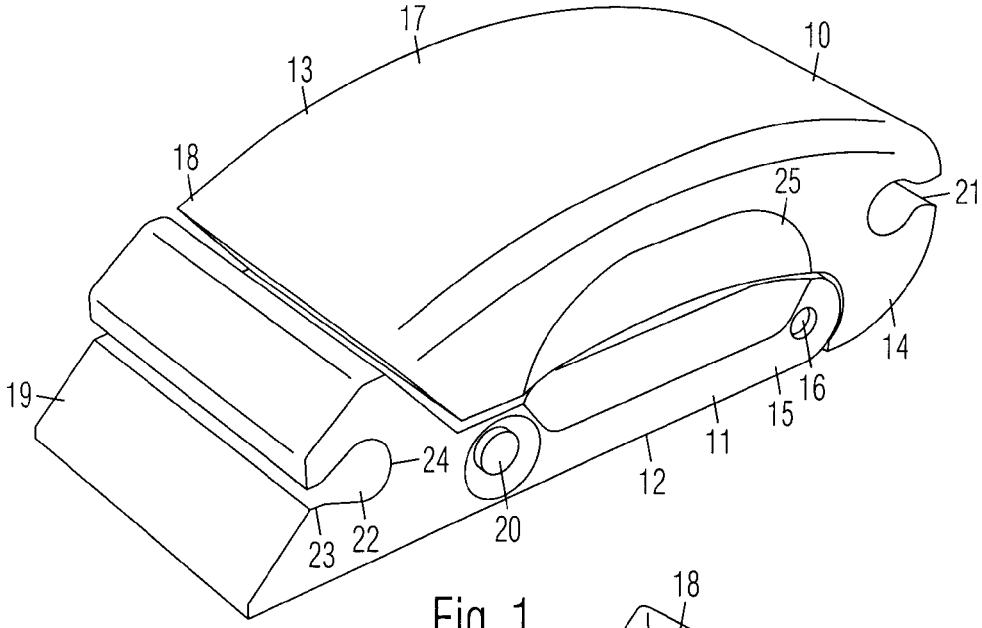
FIG. 1 is a side perspective view of the present sanding block in a closed position.

FIG. 1:

In accordance with a preferred embodiment of a sanding block shown 10 in the side perspective view of FIG. 1, it is comprised of a base member 11 with a flat working surface 12, and a tightening arm 13 with a first end 14 attached to a first end 15 of base member 10 with a hinge 16. Tightening arm 13 is shown in a closed and locked position. Tightening arm 13 has a gripping surface 17 opposite working surface 12 of base member 10. A second end 18 of tightening arm 13 is detachably secured adjacent a second end 19 of base member by a latch 20. First end 14 of tightening arm 13 is preferably rounded, and second end 19 of base member 10 is preferably beveled. A first transverse slot 21 is provided on first end 14 of tightening arm 13, and a second transverse slot 22 is provided on second end 19 of base member 10. Slots 21 and 22 are both positioned between working surface 12 and gripping surface 17. Slots 21 and 22 are each comprised of a constricted neck 23 and an enlarged inner end 24. Hinge 16 is positioned between slots 21 and 22. Concave areas 25 are provided on opposite sides of sanding block 10 for improving grip.

Figure 2:
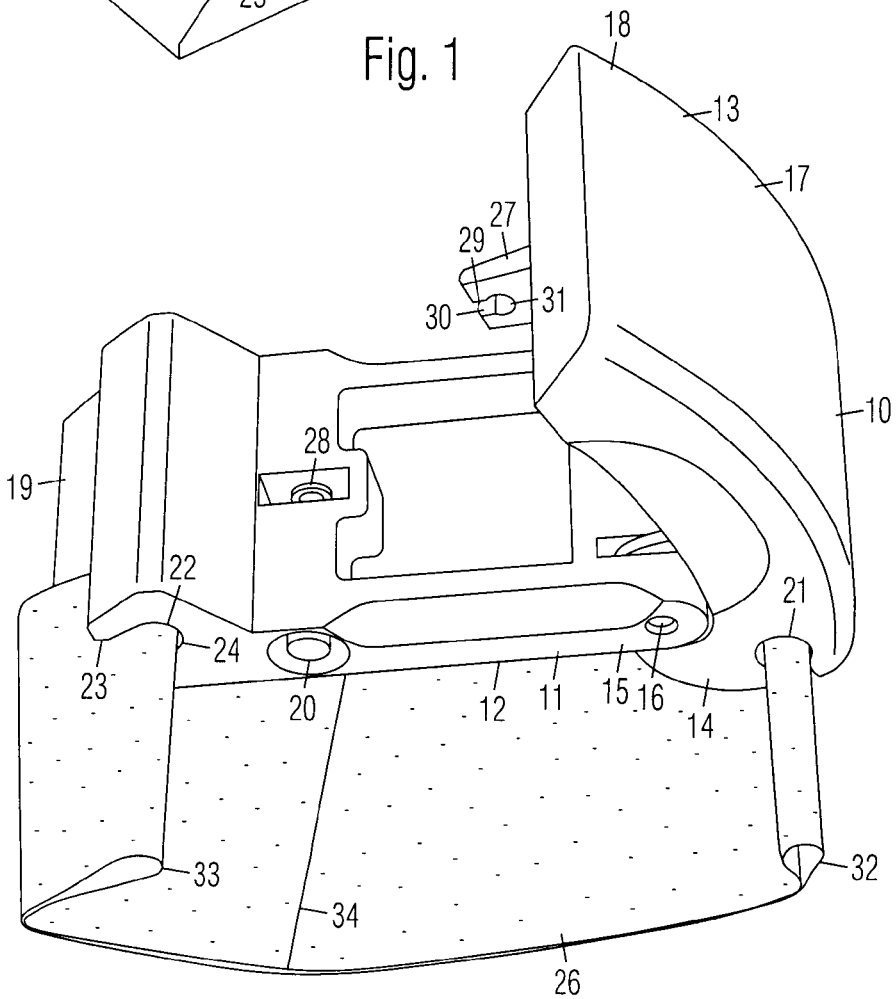
FIG. 2 is a top perspective view thereof when it is opened and a sanding belt is being installed.

FIG. 2:

A conventional sanding belt 26 in the shape of a loop is shown being installed on sanding block 10 in FIG. 2. Sanding belt 26 is originally intended for use with conventional electric belt sanders. Unlike prior art sanding blocks that require a sheet of sandpaper to be cut from a larger sheet, the present sanding block is sized and shaped to receive a conventional sanding belt without any cutting. Installation is thus easier. Further, a sanding belt is much more durable than a sheet of sandpaper.

To install sanding belt 26, tightening arm 13 is unlocked by operating latch 20 to release a catch 27 attached to an inner side of tightening arm 13 from a spring loaded pin 28 in base member 10.

Catch 27 has a slot 29 with a constricted neck 30 and an enlarged inner end 31. Once unlocked, tightening arm 13 is pivoted to its fully open position wherein slot 21 is moved toward working surface 12. Sanding belt 26 is flattened without creasing it, and its rounded ends 32 and 33 are respectively inserted into slots 21 and 22 on tightening arm 13 and base member 10. A joint 34 on sanding belt 26 is preferably positioned on the inside against working surface 12 of base member 11.

Figure 3:
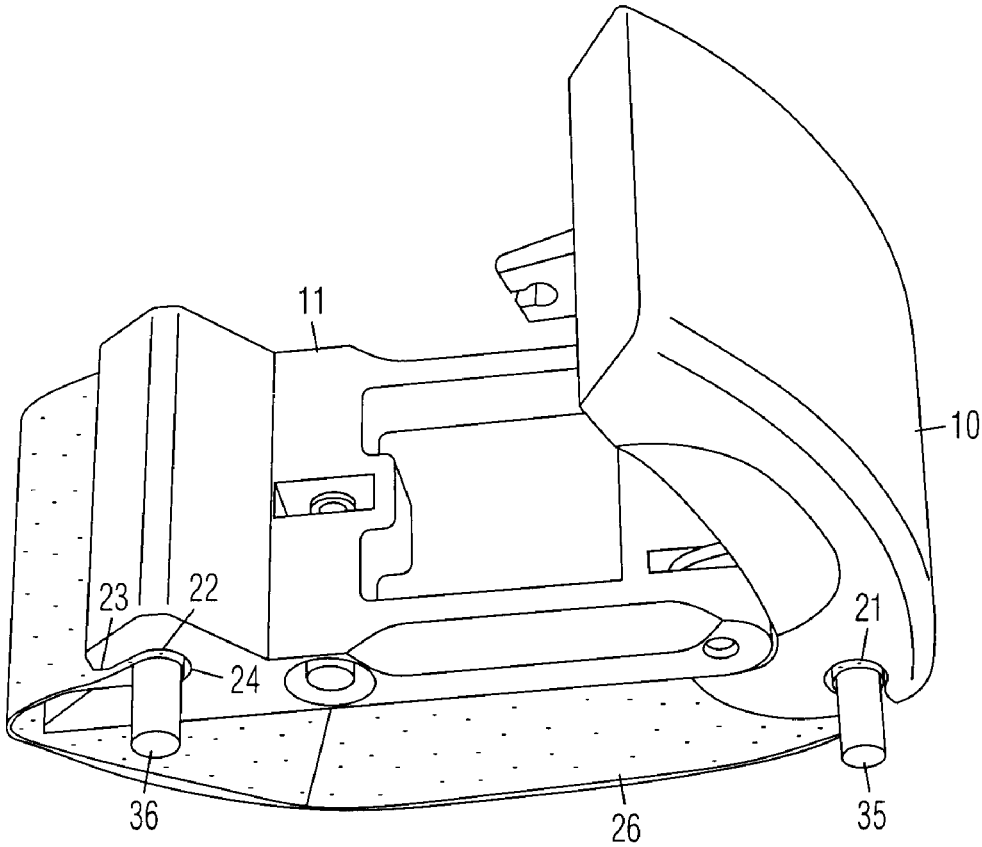
FIG. 3 is a top perspective view thereof when the ends of the sanding belt are being secured by bars.

FIG. 3:

Sanding belt 26 is shown fully inserted into slots 21 and 22 in FIG. 3. Retainers or bars 35 and 36 9 are inserted into the rounded ends of sanding belt 26 inside slots 21 and 22. Bars 35 and 36 are smaller than enlarged inner ends 24 of slots but larger than constricted necks 23. Alternatively, bars 35 and 36 may be fixedly attached to the ends of the sanding block, wherein one end of each bar is attached to the sanding block and another end is free to receive the sanding belt.

Figure 4:
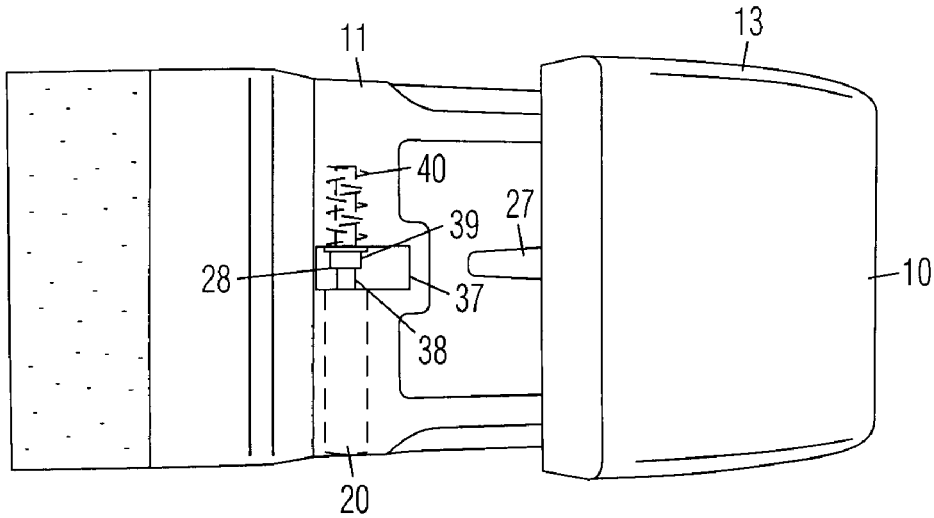
FIG. 4 is a top view thereof showing the latch.
Figure 5:
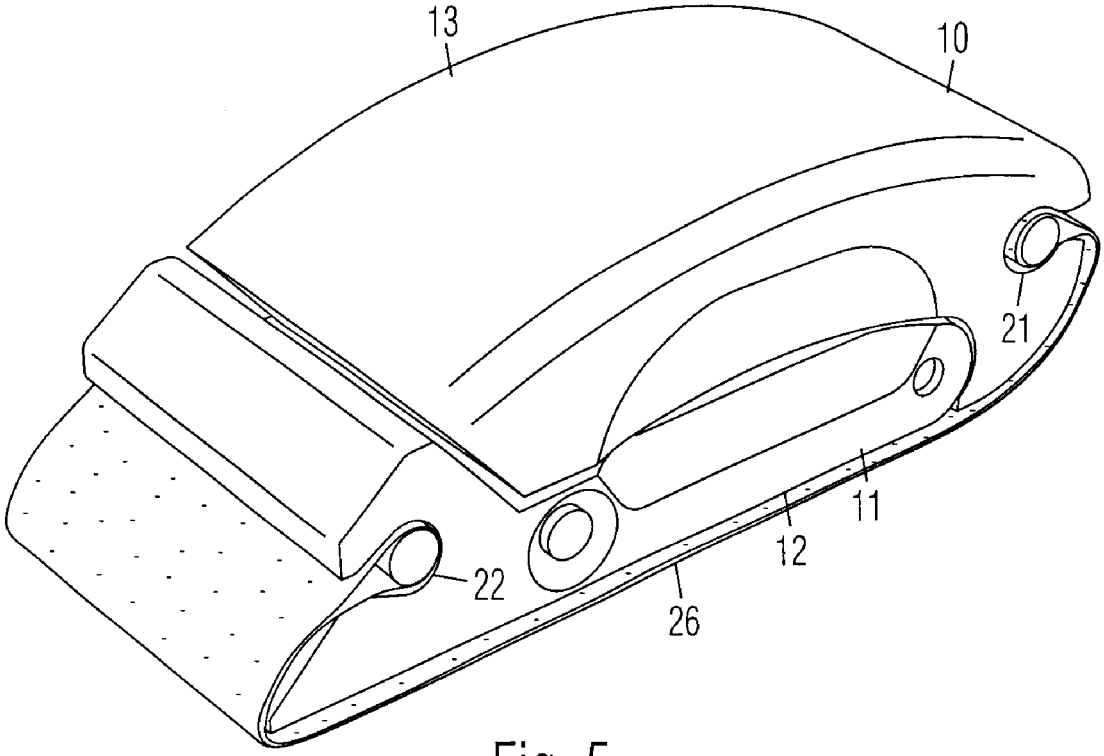
FIG. 5 is a side perspective thereof when it is closed and the sanding belt is tightened.

FIG. 4:

Tightening arm 13 is shown being closed in FIG. 4. When catch 27 is moved into a recess 37 on base member 10, it would be moved against pin 28 which is positioned across recess 37. The portion of pin 28 in recess 37 has a narrow portion 38 and a wider portion 39. The inner end of catch 27 is rounded to push aside wider portion 39 against the pressure of a spring 40 inside base member 10, so that the constricted neck of the slot on catch 27 can pass around the sides of narrow portion 38. When catch 27 is fully seated within recess 37, pin 28 would snap into the enlarged inner end of the slot on catch 27 and retain tightening arm 13 in a locked position. Tightening arm 13 can be released by pressing in latch 20.

FIG. 5:

Sanding belt 26 is shown fully installed. When tightening arm 13 is closed, slot 21 is moved away from working surface 12 to stretch and tighten sanding belt 26 against working surface 12 of base member 11. The width of base member 11 and the distance between slots 21 and 22 are selected to fit any conventional sanding belt, which are widely available in the following exemplar sizes (width× circumference): 2.5"16", 3"×18", 3"×21", 3"×24", 4"×21.75", 4"×24", etc. The sanding block may be made to fit sanding belts of any other size.

SCOPE

Although the above descriptions are specific, they should not be considered as limitations on the scope of the invention, but only as examples of the embodiments. Many substitutes and variations are possible within the teachings of the invention. For example, different attachment methods, fasteners, materials, dimensions, etc. can be used unless specifically indicated otherwise. The relative positions of the elements can vary, and the shapes of the elements can vary.

I claim:

1. A sanding block, comprising:

a base member with a flat working surface for being positioned against a generally flattened sanding belt;

a tightening arm with a first end hinged to a first end of said base member, and a second end movable between an open position away from a second end of said base member, and a closed position against said second end of said base member;

a first retaining bar secured to said tightening arm for engaging a first end of said sanding belt; and a second retaining bar secured to said base member for engaging a second end of said sanding belt; wherein when said tightening arm is opened, said first retaining bar is moved for slackening said sanding belt, and when said tightening arm is closed, said first retaining bar is moved for tightening said sanding belt against said working surface.

2. The sanding block of claim 1, wherein said first end of said tightening arm is rounded, and second end of said base member is beveled.

3. The sanding block of claim 1, wherein said base member, said tightening arm, said first retaining and said second retaining bar are arranged for securing said sanding belt, wherein said sanding belt has a width and a circumference selected from a group consisting of 2.5"×16", 3"×18", 3"×21", 3"×24", 4"×21.75", and 4"×24".

4. The sanding block of claim 1, further including a latch detachably securing said second end of said tightening arm to said second end of said base member.

5. The sanding block of claim 1, further including concave areas on opposite sides of said base member for improving grip.

6. A sanding block, comprising:

a base member with a flat working surface for being positioned against a generally flattened sanding belt;

a tightening arm with a first end hinged to a first end of said base member, and a second end movable between an open position away from a second end of said base member, and a closed position against said second end of said base member;

a hinge connecting said first end of said tightening arm to said first end of said base member;

a first retaining bar secured to said tightening arm for engaging a first end of said sanding belt; and a second retaining bar secured to said base member for engaging a second end of said sanding belt; wherein when said tightening arm is opened, said first retaining bar is moved for slackening said sanding belt, and when said tightening arm is closed, said first retaining bar is moved for tightening said sanding belt against said working surface; and said hinge is positioned between said first retaining bar and said second retaining bar for enabling slackening and tightening of said sanding belt.

7. The sanding block of claim 6, wherein said first end of said tightening arm is rounded, and second end of said base member is beveled.

8. The sanding block of claim 6, wherein said base member, said tightening arm, said first retaining bar, and said second retaining bar are arranged for securing said sanding belt, wherein said sanding belt has a width and a circumference selected from a group consisting of 2.5"×16", 3"×18", 3"×21", 3"×24", 4"×21.75", and 4"×24".

9. The sanding block of claim 6, further including a latch detachably securing said second end of said tightening arm to said second end of said base member.

10. The sanding block of claim 6, further including concave areas on opposite sides of said base member for improving grip.

11. A sanding block, comprising:

a base member with a flat working surface for being positioned against a generally flattened sanding belt;

a tightening arm with a first end hinged to a first end of said base member, and a second end movable between an open position away from a second end of said base member, and a closed position against said second end of said base member;

a first transverse slot on said tightening arm for receiving a first end of said sanding belt; a second transverse slot on said base member for receiving a second end of said sanding belt; wherein said first transverse slot and said second transverse slot are each comprised of a constricted neck and an enlarged inner end; a first retaining bar positioned in said first transverse slot for securing said first end of said sanding belt; and a second retaining bar positioned in said second transverse slot for securing said second end of said sanding belt; wherein when said tightening arm is opened, said first transverse slot is moved for slackening said sanding belt, and when said tightening arm is closed, said first transverse slot is moved for tightening said sanding belt against said working surface.

12. The sanding block of claim 11, wherein said first end of said tightening arm is rounded, and second end of said base member is beveled.

13. The sanding block of claim 11, wherein said base member, said tightening arm, said first retaining bar, and said second retaining bar are arranged for securing said sanding belt, wherein said sanding belt has a width and a circumference selected from a group consisting of 2.5"×16", 3"×18", 3"×21", 3"×24", 4"×21.75", and 4"×24".

14. The sanding block of claim 11, further including a latch detachably securing said second end of said tightening arm to said second end of said base member.

15. The sanding block of claim 11, further including concave areas on opposite sides of said base member for improving grip.

16. The sanding block of claim 11, further including a hinge connecting said first end of said tightening arm to said first end of said base member, wherein said hinge is positioned between said first transverse slot and said second transverse slot for enabling slackening and tightening of said sanding belt.

* * * * *